US005279479A

United States Patent [19]

Adama et al.

[11] Patent Number: 5,279,479

[45] Date of Patent: Jan. 18, 1994

[54] ADVANCED SEEKER WITH LARGE LOOK ANGLE

[75] Inventors: Timothy A. Adama, Ontario; Martin Pagan, Jr., Chino, both of Calif.

[73] Assignee: Hughes Missile Systems Company, Los Angeles, Calif.

[21] Appl. No.: 597,631

[22] Filed: Oct. 15, 1990

[51] Int. Cl.[5] ..... F41G 7/00; F42B 10/00; F42B 15/01; G06F 15/50

[52] U.S. Cl. ..... 244/3.16

[58] Field of Search ..... 343/765, 766; 244/3.16, 244/3.19

[56] References Cited

U.S. PATENT DOCUMENTS

| | | | |
|---|---|---|---|
| 2,512,636 | 6/1950 | Flynt . | |
| 2,924,824 | 2/1960 | Lanctot et al. | 343/765 |
| 3,166,750 | 1/1965 | Ball | 343/705 |
| 3,351,946 | 11/1967 | Verge | 343/705 |
| 3,383,081 | 5/1968 | Guttenberg | 248/346 |
| 3,439,550 | 4/1969 | Goulding | 74/89 |
| 3,987,452 | 10/1976 | Godet | 343/765 |
| 3,995,933 | 12/1976 | Crowhurst | 350/6 |
| 4,199,762 | 4/1980 | Estlick et al. | 343/765 |
| 4,238,802 | 12/1980 | Speicher | 343/765 |
| 4,240,596 | 12/1980 | Winderman et al. | 244/3.16 |
| 4,282,529 | 8/1981 | Speicher | 343/765 |
| 4,304,381 | 12/1981 | Lloyd | 248/179 |
| 4,392,140 | 7/1983 | Bastian et al. | 343/765 |
| 4,396,919 | 8/1983 | Speicher | 343/765 |
| 4,490,724 | 12/1984 | Bickman | 343/765 |
| 4,619,421 | 10/1986 | Trummer | 244/3.16 |

*Primary Examiner*—Theodore M. Blum

*Attorney, Agent, or Firm*—Charles D. Brown; Randall M. Heald; Wanda K. Denson-Low

[57] ABSTRACT

A gimbal mount for mounting a seeker for a large look angle comprises a base support frame for attachment to an airframe, a roll axis frame having a base and a pair of spaced apart forwardly positioned gimbal supports mounted for rotation about the roll axis of the frame, a pitch gimbal ring pivotally mounted on the roll axis frame for pivoting about a pitch axis, a yaw gimbal frame pivotally mounted for pivoting about a yaw axis on the pitch gimbal, a pitch drive motor and a yaw drive motor coaxially mounted directly on and coaxial of the roll axis frame, and a drive cable connecting the respective motors to the respective gimbals.

19 Claims, 2 Drawing Sheets

ADVANCED SEEKER WITH LARGE LOOK ANGLE

BACKGROUND OF THE INVENTION

The present invention relates to gimbal mounts for seekers and pertains particularly to an improved gimbal mount providing a large look angle.

Aircraft, both manned and unmanned, utilize information serving or seeker devices, such as antennas, IR/UV sensors, optical devices and the like for transmitting and receiving information. These are typically mounted for orientation within a hemispherical zone for either specific directional orientation or sweeping movement.

Many different gimbal mountings of sensing devices are known in the art, and various approaches to gimbal mounting of such sensing devices on airframes and aircraft have been attempted in the past. Because weight and space are a premium on such aircraft, it is essential that the mechanisms and instrumentation of such devices be as compact and lightweight as possible. It is also desirable that the mass of moving parts be kept to a minimum in order to reduce control complications and other problems.

High performance tactical missiles require seeker heads which can achieve look angles greater than 60 degrees for effective tracking of high speed, high altitude crossing targets. These missiles also need gimballed multiple sensors and/or additional processing electronics which reduce the achievable look angle on traditional gimbals. Historically, gimbal look angles have been restricted to about 60 degrees due to structural stiffness limitations, sensor beam blockage problems and sensor/servo control component packaging volume constraints.

It is also desirable that the seeker gimbal assemblies have means to provide stabilization by decoupling the seeker from body motion.

We have developed a three degree of freedom gimbal with roll, pitch, and yaw combined with a unique pitch and yaw drive concept that overcomes many of the aforesaid problems of the prior art. This arrangement provides for 70 degree look angles, 70 percent gimballed mass for sensor packaging, and 90 percent decoupling of body motion.

SUMMARY AND OBJECTS OF THE INVENTION

It is the primary object of the present invention to provide an improved seeker gimbal mount.

In accordance with a primary aspect of the present invention, a gimbal mount for mounting a seeker for a large look angle comprises a base support frame for attachment to an airframe, a roll axis frame having a base, a yoke mounted for rotation about the roll axis of said frame, a pitch gimbal ring pivotally mounted on the roll axis frame for pivoting about a pitch axis, a yaw gimbal frame pivotally mounted for pivoting about a yaw axis on the pitch gimbal, a pitch drive motor and a yaw drive motor coaxially mounted directly on and coaxial of the roll frame, and a cable drive connecting the respective motors to the respective gimbals.

BRIEF DESCRIPTION OF THE DRAWING

The above and other objects and advantages of the present invention will become apparent from the following description when read in conjunction with the accompanying drawings wherein.

DETAILED DESCRIPTION OF A PREFERRED EMBODIMENT

Figure 1:
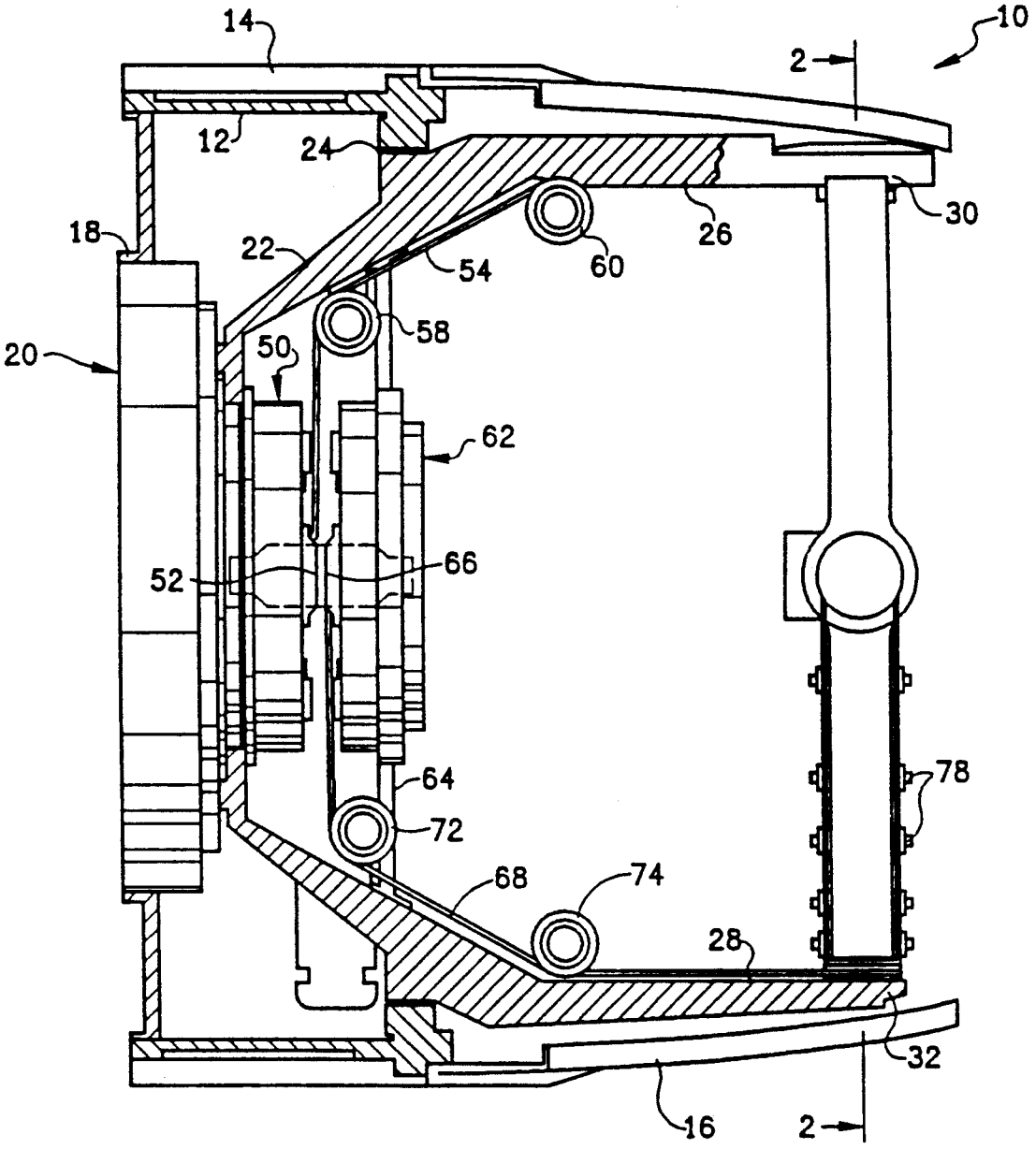
FIG. 1 is a side elevation view partially in section of a preferred embodiment of the invention.

Referring to the drawing, and particularly to FIG. 1, there is illustrated a preferred embodiment of the invention. The illustrated embodiment of the invention, designated generally by the numeral 10, comprises a base frame 12 for mounting within the forward end of an airframe, such as a missile frame or the like 14. The gimbal apparatus of the present invention provides a platform for the support or mount of seekers, such as radar antennas, IR/UV receivers, transmitters and the like, or combinations thereof. The gimbal apparatus is mounted in the forward end of the missile body and is generally positioned just aft of and covered by a window 16 forming the nose cone of the missile.

The base frame 12 comprises an inner or central support structure 18 for the central mounting of a roll motor 20 for rotating the gimbal mount about the longitudinal axis of the airframe. The roll motor 20 is mounted within the base frame, and is directly coupled or connected to a roll axis frame 22 for rotation of the frame about its rotary axis. The base mounting frame 12 extends forward and includes an annular bearing support 24 within which the roll axis frame 22 is rotatably supported or mounted. The roll axis frame 22 extends or expands radially outward at the base to accommodate a pair of drive motors to be subsequently described. The roll axis frame further comprises a pair of spaced apart forwardly extending arms 26 and 28 having forwardly positioned gimbal bearing or mounts 30 and 32 at the forward most tips thereof.

Figure 2:
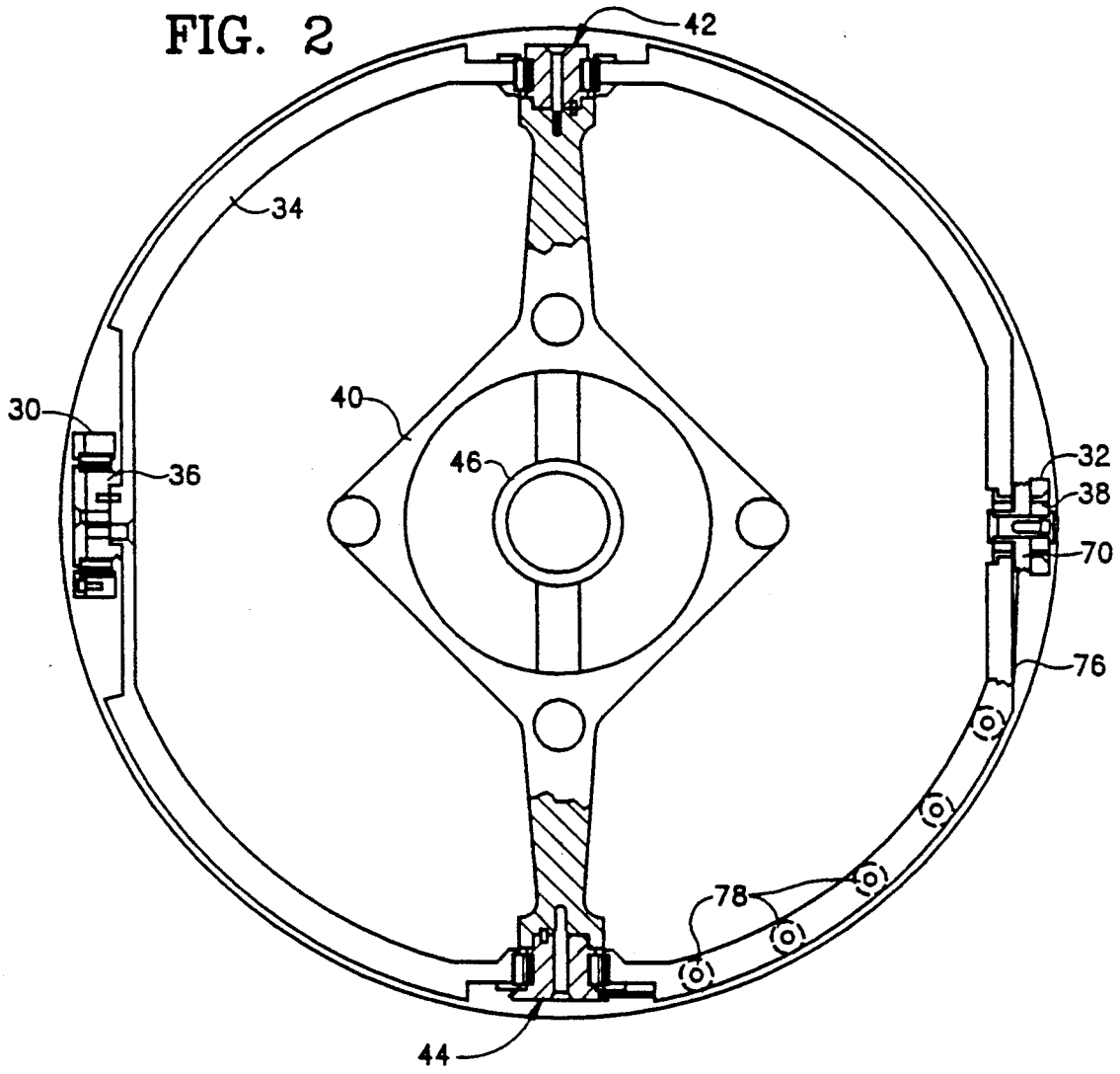
FIG. 2 is an end view partially in section taken on line 2—2 of FIG. 1.

Referring to FIG. 2, a pitch axis gimbal ring 34 is mounted by means of pitch axis journals and bearing assemblies 36 and 38 in the bearing assemblies 30 and 32 or journals of the roll axis frame. A pitch axis drive pulley is incorporated in the journal 36 for driving the pitch axis gimbal ring, as will be described.

A yaw gimbal frame 40 is pivotally mounted by gimbal mount or journal assemblies designated generally at 42 and 44 in the pitch axis gimbal ring orthogonal to the axis of the pitch axis gimbal. A yaw axis drive pulley is incorporated in the yaw gimbal frame journal assembly 44. The gimbal frame 40 is a platform for mounting a sensor device or the like (not shown). A two axis rate gyro or equivalent rate sensor 46 is mounted centrally of the yaw gimbal frame 40, with its sensing axes aligned with the pitch and yaw axes.

Drive means for the pitch axis gimbal ring for driving it about its axis comprises a pitch drive motor 50 mounted at the base and coaxially of the roll axis frame. The drive means includes a drive pulley 52 on which is mounted a drive cable 54, which extends to and drivingly connects to a drive pulley incorporated in bearing assembly 36 which as shown supports the pitch axis gimbal ring 34 (FIG. 2). The drive cable 54 is supported for its movement closely along an inner wall of the roll axis frame by means of a plurality of idler support bearing or pulleys 58 and 60. The drive motor 50 is a large diameter, short axial length, high torque motor coupled on a direct one-to-one drive ratio to the pitch axis gimbal ring 34. The motor may be a high speed stepping motor, and because of the direct one-to-one drive ratio does not need to make a complete revolution in rotating the pitch axis gimbal ring 34 ring to its limits. The large diameter short length of the motor coaxially mounted within the roll axis frame provides a highly compact drive arrangement, providing optimal use of the space available for the drive assembly.

The yaw drive assembly comprises a yaw drive motor 62 similar to that of the pitch motor mounted just forward thereof and coaxially thereof within a support frame 64 of the roll axis frame 22 (FIG. 1). The drive assembly includes a drive pulley 66 on which is mounted a drive cable 68, which extends to and is drivingly connected or mounted to one groove of an idler pulley 70, rotatably mounted on the pitch axis journal 38 (FIG. 2). The first drive cable 68 is supported by suitable bearing or idler pulleys 72 and 74 (FIG. 1). A second drive cable 76 is drivingly connected at one end to the yaw idler pulley 70, and extends to and connects to the yaw axis drive pulley at 44 mounted to the yaw gimbal frame 40 (FIG. 2). A plurality of cable guide bearings 78 are positioned along the quadrant of the pitch gimbal ring 34 for supporting the drive cable 76 for extending around that sector of the gimbal ring. The pitch and yaw drive motors 50 and 62 are large diameter to length motors, and may be identical and have identical drive pulleys 52 and 66. The motors 50 and 62 have a diameter to length of on the order of about five to one (5:1) but may be higher. The roll motor 20 is of a similar construction.

The drive cables 54 and 68 do not need to encircle the drive pulleys 52 and 66 on the motors 50 and 62 in order to drive the pitch axis gimbal ring 34 and the yaw gimbal frame 40 to their respective pivotal limits of plus and minus about 70 degrees. Therefore, the terminal ends of the respective drive cables 54 and 68 may be suitably attached to the respective drive pulleys 52 and 66.

The above described drive arrangement provides compact centrally located drive motors that are located and positioned to provide minimum interference with and intrusion into space available for mounting of processing and control electronics. The enlarged space for accommodating processing electronics within the missile diameter enables the structure to provide for larger look angles than previously available on the order of plus or minus 70 degrees This provides a high volume on the order of seventy percent of the gimballed structure volume available for sensor packaging. The drive arrangement also provides for a minimum of ninety percent decoupling of body motion inputs from the sensor assembly.

In operation, a sensor mounted to the yaw gimbal frame on an airborne missile would either be sweeping an area or tracking a target. In either event, the sensor can be pivoted by a combination of rotation of the pitch gimbal ring and the yaw gimbal frame up to 70 degrees to either side of the axis of the airframe by means of the drive motors. The location of the drive motors totally decouples the mass thereof from the pitch and yaw gimbals. The mass thereof is carried entirely by the roll axis frame.

While we have illustrated and described our invention by means of specific embodiments, it is to be understood that numerous changes and modifications may be made therein without departing from the spirit and scope of the invention as defined in the appended claims.

We claim:

1. A gimbal mount for mounting a sensor for a large look angle, comprising:

a base support frame for attachment to an airframe;

a roll axis frame having a base and a pair of spaced apart forwardly positioned gimbal supports mounted for rotation about the roll axis of said frame;

a pitch gimbal ring pivotally mounted on said roll axis frame for pivoting about a pitch axis;

a yaw gimbal frame pivotally mounted for pivoting about a yaw axis on said pitch gimbal;

a pitch drive motor, a roll drive motor, and a yaw drive motor coaxially mounted directly on and coaxial of said roll axis frame; and cable drive means connecting said respective motors to the respective gimbals.

2. A gimbal mount according to claim 1 wherein:

said drive means is in a direct one-to-one drive ratio between said respective drive motor and the respective gimbal.

3. A gimbal mount according to claim 1 wherein:

the cable drive means for the yaw gimbal frame includes an idler pulley and plurality of cable bearing supports extending along a quadrant of said pitch gimbal frame.

4. A gimbal mount according to claim 1 wherein:

the axis of said pitch axis gimbal and the axis of said yaw axis gimbal lie in a common plane.

5. A gimbal mount according to claim 1 wherein:

said drive motors have a very large diameter to length.

6. A gimbal mount according to claim 5 wherein:

said diameter to length is on the order of about five to one.

7. A gimbal mount according to claim 2 wherein:

the cable drive means for the yaw gimbal frame comprises first and second drive cables drivingly coupled by means of an idler pulley and plurality of cable bearing supports extending along a quadrant of said pitch gimbal frame for supporting said second drive cable.

8. A gimbal mount according to claim 7 wherein:

said drive motors have a very large diameter to length.

9. A gimbal mount according to claim 8 wherein:

said diameter to length is on the order of about five to one.

10. A gimbal mount according to claim 9 wherein:

the axis of said pitch axis gimbal and the axis of said yaw axis gimbal lie in a common plane.

11. A gimbal mount according to claim 1 further comprising:

a roll drive motor mounted directly on and coaxial of said roll axis frame.

12. A gimbal mount for mounting a seeker for a large look angle, comprising:

a base support frame for mounting on an airframe;

a roll axis frame having a base and a pair of spaced apart forwardly extending arms having forwardly positioned gimbal supports thereon mounted for rotation about the roll axis of said airframe;

a roll drive motor mounted directly on and coaxial of said roll axis frame and drivingly connected thereto; a pitch axis gimbal ring pivotally mounted on said gimbal support on said roll axis frame for pivoting about a pitch axis orthogonal to said roll axis;

a yaw axis gimbal frame pivotally mounted on said pitch gimbal for pivoting about a yaw axis orthogonal to said roll axis;

a pitch drive motor ad a yaw drive motor on and mounted coaxial of said roll axis frame; and cable drive means connecting said respective pitch drive and yaw drive motors for rotation of the respective gimbals.

13. A gimbal mount according to claim 12 wherein:

said drive means is in a direct one-to-one drive ratio to minimize body coupling between said respective drive motor and the respective gimbal.

14. A gimbal mount according to claim 13 wherein:

the cable drive means for the yaw gimbal frame includes an idler pulley and plurality of cable bearing supports extending along a quadrant of said pitch gimbal frame.

15. A gimbal mount according to claim 14 wherein:

the axis of said pitch axis gimbal and the axis of said yaw axis gimbal lie in a common plane.

16. A gimbal mount for mounting a seeker for a large look angle, comprising:

a base support frame for mounting on an airframe;

a roll axis frame having a base and a yoke mounted for rotation about the roll axis of said airframe including a pair of spaced apart forwardly positioned gimbal supports;

a roll axis drive motor mounted on said base support frame and connected for direct drive of said roll axis frame;

a pitch gimbal ring pivotally mounted on said gimbal support on said roll axis frame for pivoting about a pitch axis;

a pitch drive motor mounted on said roll axis frame;

pitch cable drive means connecting said pitch drive motor to the pitch gimbal ring;

a yaw gimbal frame pivotally mounted on said pitch gimbal for pivoting about a yaw axis;

a yaw drive motor coaxially mounted coaxial of said roll axis frame; and pitch cable drive means connecting said pitch drive motor to the pitch gimbal.

17. A gimbal mount according to claim 16 wherein:

said drive means is in a direct one-to-one drive ratio between said respective drive motor and the respective gimbal.

18. A gimbal mount according to claim 17 wherein:

the cable drive means for the yaw gimbal frame includes an idler pulley and plurality of cable bearing supports extending along a quadrant of said pitch gimbal frame.

19. A gimbal mount according o claim 17 wherein:

the axis of said pitch axis gimbal and the axis of said yaw axis gimbal lie in a common plane.

* * * * *